US010721980B2

(12) United States Patent
Inzer

(10) Patent No.: US 10,721,980 B2
(45) **Date of Patent: *Jul. 28, 2020**

(54) NOTCH SLEEVE SUPPORT SHIRT

(71) Applicant: John Inzer, Longview, TX (US)

(72) Inventor: John Inzer, Longview, TX (US)

( * ) Notice: Subject to any disclaimer, the term of this patent is extended or adjusted under 35 U.S.C. 154(b) by 13 days.

This patent is subject to a terminal disclaimer.

(21) Appl. No.: 14/657,293

(22) Filed: Mar. 13, 2015

(65) Prior Publication Data

US 2016/0262474 A1 Sep. 15, 2016

(51) Int. Cl.
*A41D 27/10* (2006.01)
*A41D 13/05* (2006.01)
*A41D 13/00* (2006.01)

(52) U.S. Cl.
CPC ..... *A41D 27/10* (2013.01); *A41D 13/0015* (2013.01); *A41D 13/0512* (2013.01)

(58) Field of Classification Search
CPC ..... A41D 27/10; A41D 13/0015; A41B 1/08
USPC ..... 2/125
See application file for complete search history.

(56) References Cited

U.S. PATENT DOCUMENTS 2,035,377 A 3/1936 Redmond
2,164,036 A 6/1939 Lane
2,309,601 A 1/1943 Kneibler
2,439,149 A * 4/1948 Smicker ..... A41D 1/04 2/111
2,687,527 A * 8/1954 Rendino ..... A41D 27/136 2/55
2,741,203 A 4/1956 Rand
2,871,849 A 2/1959 Clark
2,959,837 A 11/1960 Jette
3,066,418 A * 12/1962 Terry ..... A41D 1/04 2/115
3,289,748 A 12/1966 Jennings
3,771,169 A 11/1973 Edmund
3,789,429 A 2/1974 Garcia
4,384,369 A 5/1983 Prince
4,473,908 A * 10/1984 Knecht ..... A41B 1/00 2/114
4,547,904 A 10/1985 Long et al.
4,563,157 A 1/1986 Hoshino
5,046,194 A 9/1991 Alaniz et al.
5,097,535 A 3/1992 Dye et al.
5,359,731 A 11/1994 Cavalier
5,383,235 A * 1/1995 Peters ..... A41D 13/0015 2/102
5,392,466 A 2/1995 Chou et al.
(Continued)

FOREIGN PATENT DOCUMENTS

AU 3710193 A 10/1993

*Primary Examiner* — Anne M Kozak
(74) *Attorney, Agent, or Firm* — Dinsmore & Shohl LLP

(57) ABSTRACT

A support shirt is provided with round sleeve holes located on a front portion of the shirt body and a notched sleeve design which spreads the stress on the fabric during lifting along the length of the sleeves as opposed to prior art shirt designs in which stress occurs in the very narrow chest plate of the shirt and at the point where the sleeves are attached to the shirt body. The notched sleeve design also results in the sleeves tilting downwardly and curving inwardly to provide additional support during lifting. As a result of the notched sleeve design, the support shirt is more durable and aids in reducing erratic bar movement during lifting, thrusting, or pushing.

11 Claims, 7 Drawing Sheets

(56) References Cited

U.S. PATENT DOCUMENTS 5,431,030 A * 7/1995 Ishizaki ..... A41B 9/00 2/243.1
5,822,794 A 10/1998 Allred
5,829,058 A * 11/1998 Dicker ..... A41D 13/0015 2/227
5,937,442 A 8/1999 Yamaguchi et al.
5,957,878 A * 9/1999 Gilliam ..... A41D 13/0015 128/856
5,991,923 A 11/1999 Maria
6,021,524 A 2/2000 Wu et al.
6,178,557 B1 * 1/2001 Bel Monte ..... A41D 27/13 2/53
6,263,510 B1 7/2001 Bay et al.
6,301,717 B1 * 10/2001 Matsumoto ..... A41D 3/02 2/125
6,446,264 B2 * 9/2002 Fairhurst ..... A41D 7/00 2/2.15
6,675,389 B1 1/2004 Kublick
D498,037 S 11/2004 Bay
6,854,130 B2 2/2005 van der Sleesen
6,892,396 B2 5/2005 Uno et al.
7,111,328 B2 9/2006 Bay
D608,077 S * 1/2010 Bybee ..... D2/717
D618,440 S 6/2010 Parker
D620,231 S 7/2010 Parker
7,752,681 B2 * 7/2010 Michel ..... A41B 9/00 2/409
7,810,171 B2 10/2010 Moore
7,886,367 B2 * 2/2011 Chapuis ..... A41D 13/0015 2/22
7,941,871 B1 5/2011 Jorgensen
8,001,618 B2 8/2011 Bay
D674,168 S * 1/2013 Kajino ..... D2/840
8,533,864 B1 9/2013 Kostrzewski
8,578,517 B2 11/2013 Alaniz et al.
D698,124 S * 1/2014 Yu ..... D2/840
8,910,317 B2 * 12/2014 Decker ..... A41D 13/0002 2/227
2004/0016041 A1 * 1/2004 Uno ..... A41D 13/0015 2/113
2005/0166298 A1 8/2005 Pieroranzio
2005/0241044 A1 * 11/2005 Zorica ..... A41D 27/10 2/69
2006/0053658 A1 3/2006 Voughlohn
2006/0085889 A1 * 4/2006 Okajima ..... A41D 1/04 2/77
2006/0230490 A1 10/2006 Okajima
2006/0272069 A1 12/2006 Sheetz
2006/0277653 A1 * 12/2006 Okajima ..... A41D 3/00 2/93
2007/0000015 A1 * 1/2007 Alaniz ..... A41D 13/0015 2/115
2007/0074328 A1 * 4/2007 Melhart ..... A41D 13/0015 2/69
2008/0196136 A1 8/2008 Fellouhe et al.
2009/0056870 A1 3/2009 Glenn
2009/0077708 A1 * 3/2009 Takamato ..... A41D 1/04 2/69
2009/0100569 A1 4/2009 Butler
2009/0113596 A1 * 5/2009 Young ..... A41D 13/0015 2/69
2009/0139005 A1 6/2009 Whaley
2010/0043115 A1 2/2010 Weatherill et al.
2010/0064415 A1 3/2010 Melhart et al.
2010/0077527 A1 4/2010 Lee et al.
2010/0125930 A1 5/2010 Burrell, IV
2010/0138976 A1 6/2010 Appelbaum
2010/0218300 A1 9/2010 Alaniz et al.
2010/0242156 A1 9/2010 Calautti
2010/0299798 A1 12/2010 Fayle et al.
2011/0009793 A1 1/2011 Lucero et al.
2011/0035859 A1 * 2/2011 Koga ..... A41D 13/0015 2/69
2011/0083246 A1 4/2011 Vitarana
2011/0167539 A1 * 7/2011 Tatsuno ..... A41D 27/10 2/243.1
2011/0185476 A1 8/2011 Boisseau et al.
2011/0302686 A1 * 12/2011 Chapuis ..... A41D 13/0015 2/69
2012/0174285 A1 7/2012 Williams et al.
2012/0204314 A1 8/2012 Pounds et al.
2013/0067628 A1 3/2013 Harb
2013/0160189 A1 6/2013 Yang
2013/0167285 A1 7/2013 Decker
2013/0237110 A1 9/2013 Morales
2013/0298302 A1 11/2013 Whaley
2013/0312154 A1 * 11/2013 Koga ..... A41D 13/0015 2/69
2013/0318677 A1 * 12/2013 Liu ..... A41D 27/10 2/69
2013/0326785 A1 12/2013 Cornacchiari et al.
2014/0317826 A1 10/2014 Decker
2014/0325732 A1 11/2014 Anderson
2015/0020288 A1 1/2015 Picot
2015/0082510 A1 * 3/2015 Inzer ..... A41D 13/0015 2/125
2015/0164148 A1 * 6/2015 Takamoto ..... A41D 27/10 2/69
2015/0189926 A1 7/2015 Bunting
2015/0189927 A1 7/2015 Bunting
2015/0196072 A1 * 7/2015 Inzer ..... A41D 13/0002 2/69
2016/0262460 A1 9/2016 Inzer
2016/0262474 A1 9/2016 Inzer
2016/0286872 A1 10/2016 Wilson
2016/0286873 A1 10/2016 Knipp et al.
2016/0345647 A1 12/2016 Ladaev
2017/0027235 A1 2/2017 Inzer
2017/0232290 A1 8/2017 Alaniz, III

* cited by examiner

NOTCH SLEEVE SUPPORT SHIRT

BACKGROUND

The subject matter described herein relates to a shirt or garment which covers the upper torso of a wearer. Specifically, embodiments are directed to a support shirt providing support along the chest and shoulder regions of the wearer. The support shirt can be used for sporting activities where support of the chest and shoulders is desired. One such application of the support shirt is a bench press shirt for support in weightlifting activities.

Bench press shirts provide an increase in the amount of weight a bench presser can lift as well as increased safety to the bench presser. Typically, bench press shirts are made of high strength materials, such as double knit polyester, canvas or denim which are designed to fit the wearer tightly. Such bench press shirts have portions covering the upper arms and chest which typically provide a taut fit during lifting. Bench press shirts can also be made of spandex type fabric and be effective for support. As distinguished from ordinary shirts or t-shirts, bench press shirts have at least one area of increased support/strength, designed to augment movement of a body part by increased strength of material and/or compression.

In a bench pressing exercise, a weightlifter lies substantially flat on his back, with arms upraised. The weightlifter lowers a weight to the chest, and then pushes it vertically upward until the arms are straight. The tautness in a typical bench press shirt provides assistance and increased support for the underlying muscles, thereby allowing the weightlifter to lift more weight.

Bench press shirts rely on the tautness of the fabric across the chest of a user for support during lifting. It is desirable for a bench press shirt to have forward tilted sleeves, corresponding with the position of the arms during lifting. In some bench press shirts, the patterns for the front and back of the shirt, when sewn together, form arm holes. Other bench press shirts utilize a round hole sleeve pattern in the front of the shirt. In such a pattern, the shirt has two straight sleeves sewn into round holes in the front of the shirt body. Such round hole shirts may result in erratic bar movement during lifting because a great amount of stress occurs in the fabric along the very narrow chest plate between the sleeves and at the seams where the sleeves are attached to the shirt body. The entire forward sleeve tilt in round hole shirts depends on a very narrow chest plate in the design of the shirt. Therefore, a need exists in this art for a bench press shirt which spreads the stress on the fabric over a larger area while still utilizing a round hole shirt design.

BRIEF SUMMARY

That need is addressed by embodiments of the present invention which provide for a bench press shirt with round sleeve holes located on a front portion of the shirt body and a notched sleeve design which spreads the stress on the fabric during lifting along the length of the sleeves as opposed to prior art shirt designs in which stress occurs in the very narrow chest plate of the shirt and at the point where the sleeves are attached to the shirt body. In some embodiments, the notched sleeve design also results in the sleeves tilting downwardly and curving inwardly to provide additional support during lifting. In other embodiments, the sleeves may be tilted upwardly and/or have no inwardly curvature. As a result of the notched sleeve design, the support shirt is more durable and aids in reducing erratic bar movement during lifting. Additionally, the notched sleeve design provides the ability to adjust the tilt of the sleeves and improve performance during lifting, thrusting, pushing, and the like.

In accordance with one embodiment of the present invention, a support shirt is provided and comprises a shirt body and a pair of shirt body sleeves positioned adjacent to an upper portion of the shirt body. The sleeves are attached to the shirt body at round sleeve body holes located on the front of the shirt body. Each of the sleeves has a first end adapted to be attached to a respective sleeve arm hole, and opposite end, a first side edge, and a second side edge. The first end of the sleeve includes a notch portion which may take the form of a groove, a recess, a channel, or the like in the fabric. The notch is located between opposing edges of the first sleeve end. In some embodiments, the notch may comprise a curvilinear surface. The first and second edges of the sleeve are joined together by a coupling seam such that when the sleeves are attached to the sleeve body holes, the sleeves can be made to tilt upwardly or downwardly from the support shirt body. Additionally, the sleeves may be straight, or may curve inwardly from the support shirt body.

The notch portion of the sleeve may be located at any position along the first end of the sleeve. For example, in one embodiment, the notch portion is located approximately midway between the first and second edges of the sleeve. In another embodiment, the notch portion is located on opposing first and second edges of the sleeve such that when the sleeve is formed by joining the opposing edges along a coupling seam, the notch is formed. By adjusting the location of the notch on the sleeve, the amount of and direction of the tilt of the sleeve may be controlled.

The shirt body and sleeve portions of the support shirt may comprise a single or multiply fabric comprised of canvas, polyester, spandex, nylon, or cotton. As used herein, the term "fabric" is meant to include not only woven fibrous materials but also non-woven materials such as, for example, substantially continuous sheets of polymeric material. The shirt body and sleeve members may be the same or of different material. Either the shirt body or sleeves may be of stretchable or non-stretchable material. Preferably, the fabric will have a tensile strength of at least about 90 up to about 1000 psi, although fabrics having differing strengths may be used so long as the fabrics resist tearing and maintain their tautness during lifting. The type of fiber, denier, and weight of the fabric will affect tensile strength.

In an embodiment, the sleeve portions of the support shirt extend forward of a frontal plane extending across the support shirt body at an angle of from about 60° to about 180°. In an embodiment, the sleeve portions of the support shirt extend from a transverse plane extending substantially perpendicular to said frontal plane at an angle of from between about +45° to about −45°.

Accordingly, it is a feature of the present invention to provide a support shirt having a round sleeve hole design with notched sleeves which spread the stresses on the shirt fabric resulting in a durable shirt which aids in eliminating erratic bar movement during lifting. It is a further feature of the invention to adjust the position of the notch on the sleeves to adjust the upward and downward tilt of the sleeves. Other features and advantages of the present invention will be apparent from the following detailed description, the accompanying drawings, and the appended claims.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
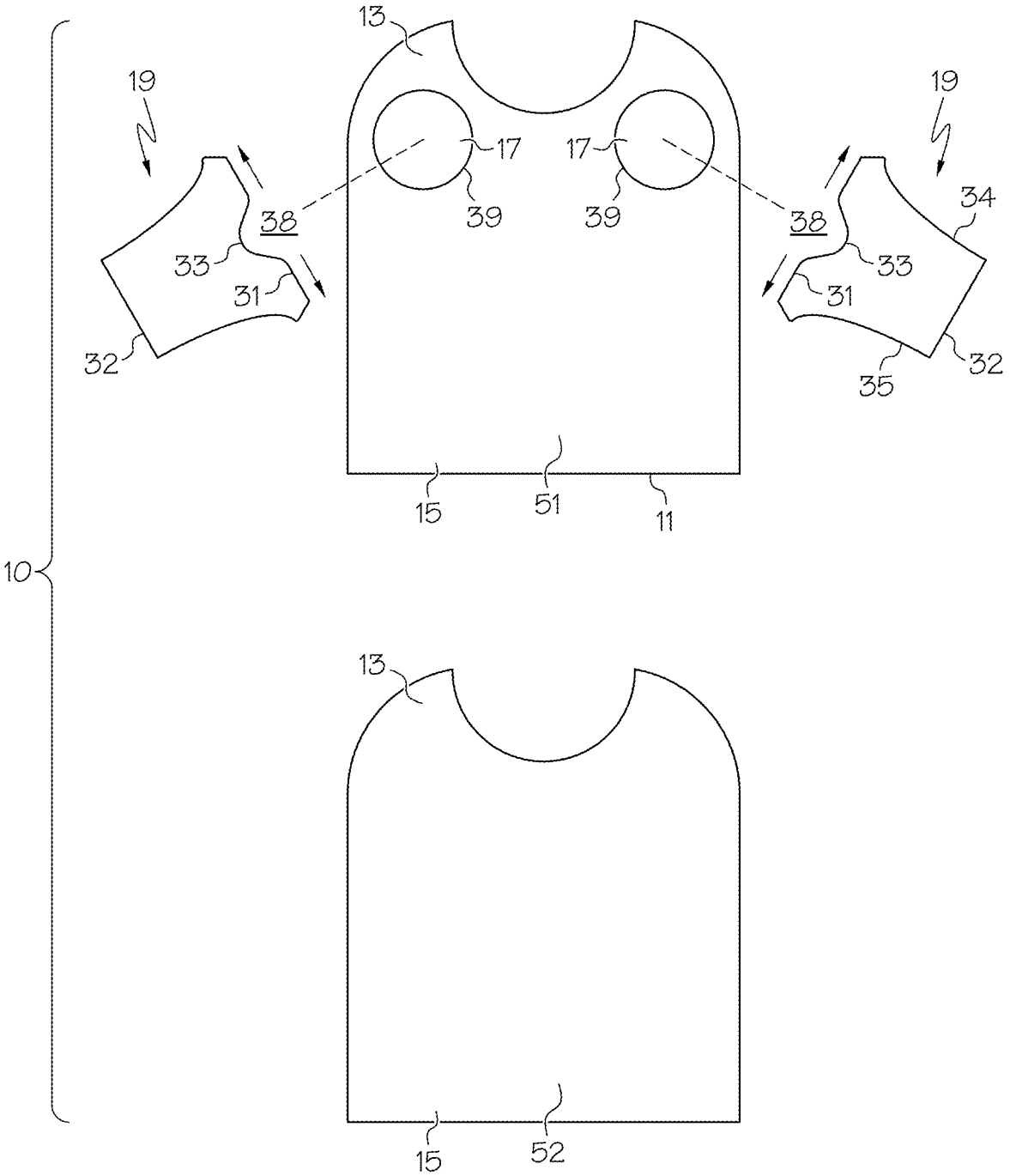
FIG. 1 is an exploded view of an embodiment of the support shirt design depicting a pattern for assembly of the front and back shirt body and sleeves.

According to one embodiment, the support shirt 10 comprises a shirt body 11 worn over the torso of an individual. The shirt body 11 comprises an upper shirt body 13 and a lower shirt body 15 as shown, for example, in FIGS. 1, 3, and 6-11. Shirt body 11 has a shirt front 51 and a shirt back 52 joined together at body seams 53.

The shirt body 11 is comprised of a supporting fabric extending across at least the upper shirt body 13. The support shirt is sized so that the supporting fabric is taut against the wearer's body when worn, providing support across the upper torso of the individual. The tautness of the fabric provides increased pressure exerted across the pectoralis major and serratus anterior muscles of the wearer. During an exercise such as a bench press, the shirt body 11 provides support as the bar is raised through a bar path (i.e., the path a weighted bar traverses as the user lifts the weight above his torso). The fabric may be comprised of stretchable or non-stretchable material. Additionally, the fabric may be single ply or multi-ply and may be comprised of: canvas fabric; polyester; spandex type fabric; nylon fabric; cotton; or any kind of fabric that holds tautness. Shirt body sleeve holes 17 are positioned on the front portion 51 of the shirt near the upper shirt body 13, corresponding with the area of traversal of the wearer's arms. The fabric comprising shirt body 11 has a tensile strength which will withstand the stresses and strains of lifting without fabric tearing. In some embodiments, the fabric has a tensile strength of from at least about 90 psi to about 1000 psi, although fabrics having differing strengths may be used so long as the fabrics maintain their tautness during lifting and resist tearing.

Figure 6:
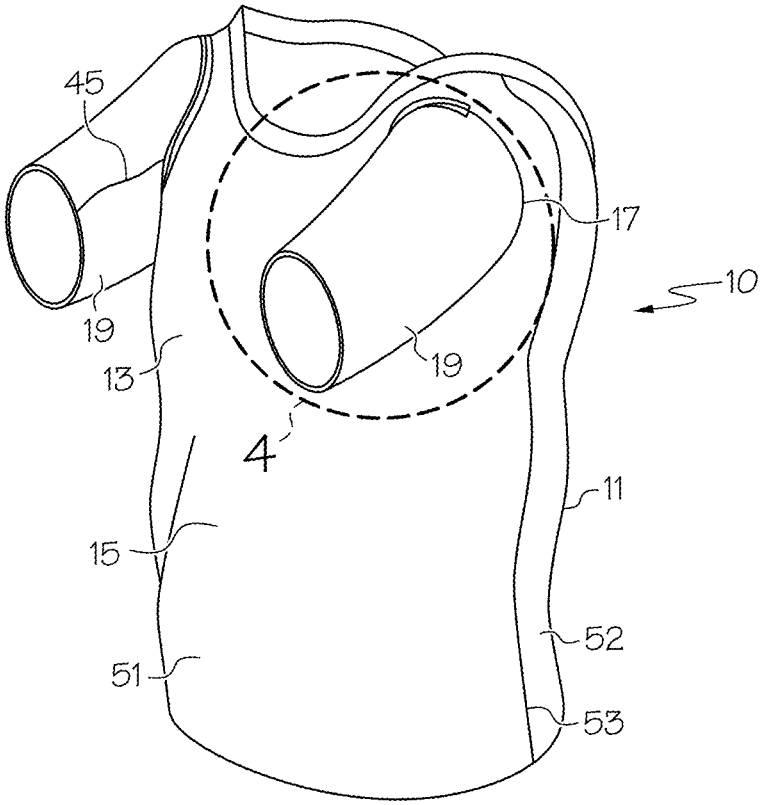
FIG. 6 depicts a perspective view of an embodiment of the notch sleeve support shirt.
Figure 7:
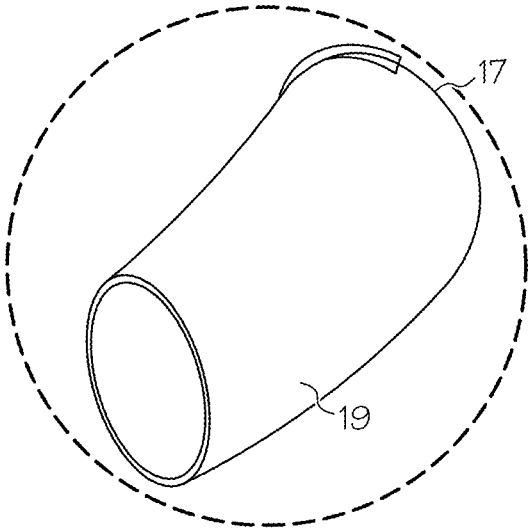
FIG. 7 depicts an enlarged perspective view of a sleeve of the support shirt of FIG. 6.
Figure 8:
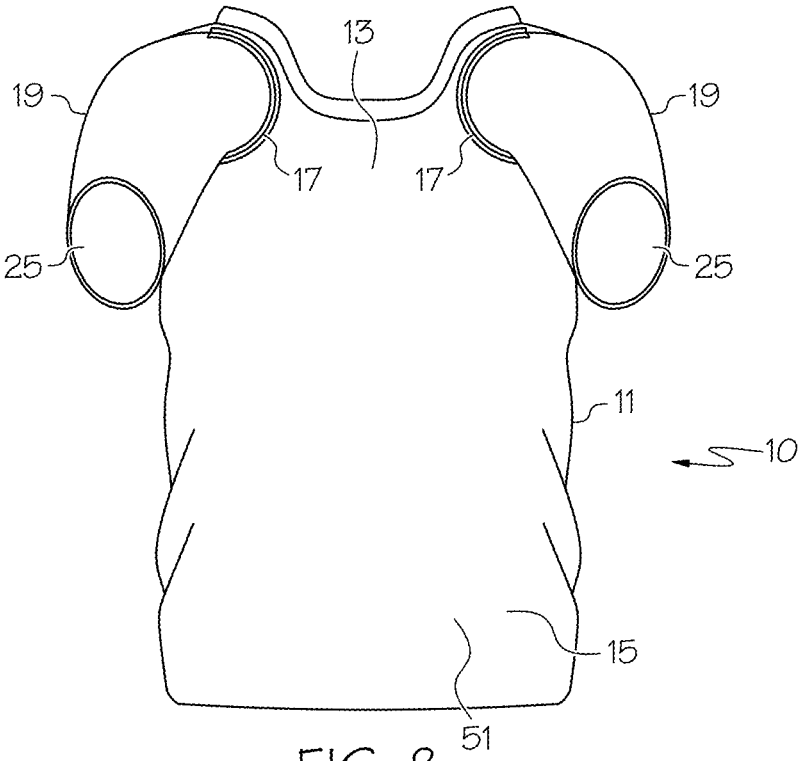
FIG. 8 depicts a front view of the notch sleeve support shirt of FIG. 6.
Figure 9:
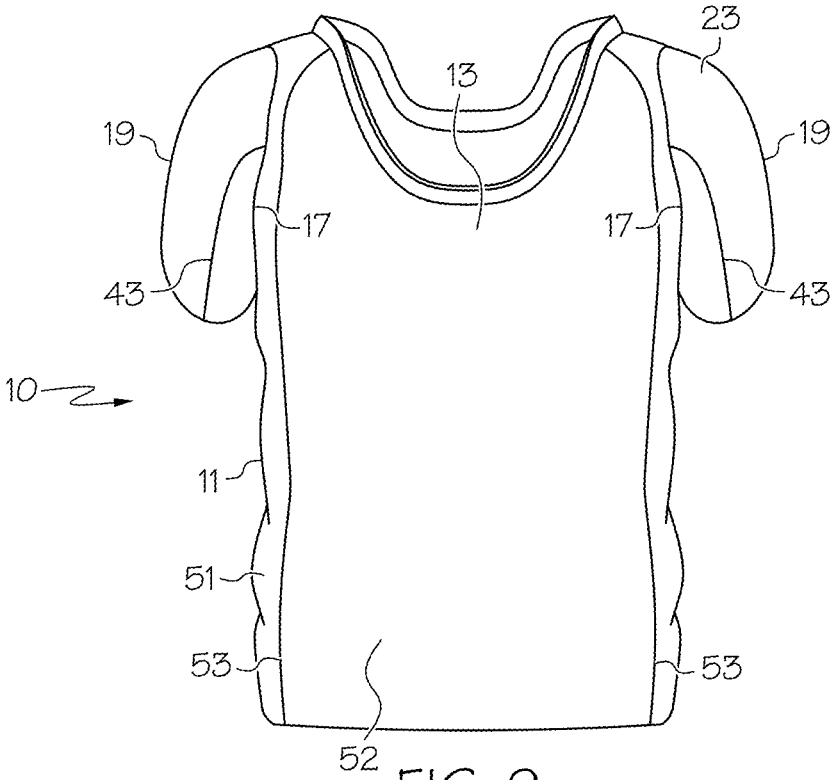
FIG. 9 depicts a back view of the notch sleeve support shirt of FIG. 6.

Sleeves 19 are attached to the shirt body 11 at the shirt body sleeve holes 17 as shown, for example, in FIGS. 6 and 8. The sleeve portions 19 provide compression across the shoulders of the wearer, corresponding with the anterior deltoid, coracobrachialis, scapulae fixer, biceps, and triceps of the wearer. The sleeves 19 are sized such that the fabric is taut when worn, providing support for the shoulders during lifting. The fabric may be comprised of stretchable or non-stretchable material. Additionally, the fabric may be single ply or multi-ply and may be comprised of: canvas fabric; polyester; spandex type fabric; nylon fabric; cotton; or any kind of fabric that holds tautness and has sufficient tensile strength.

Figure 10:
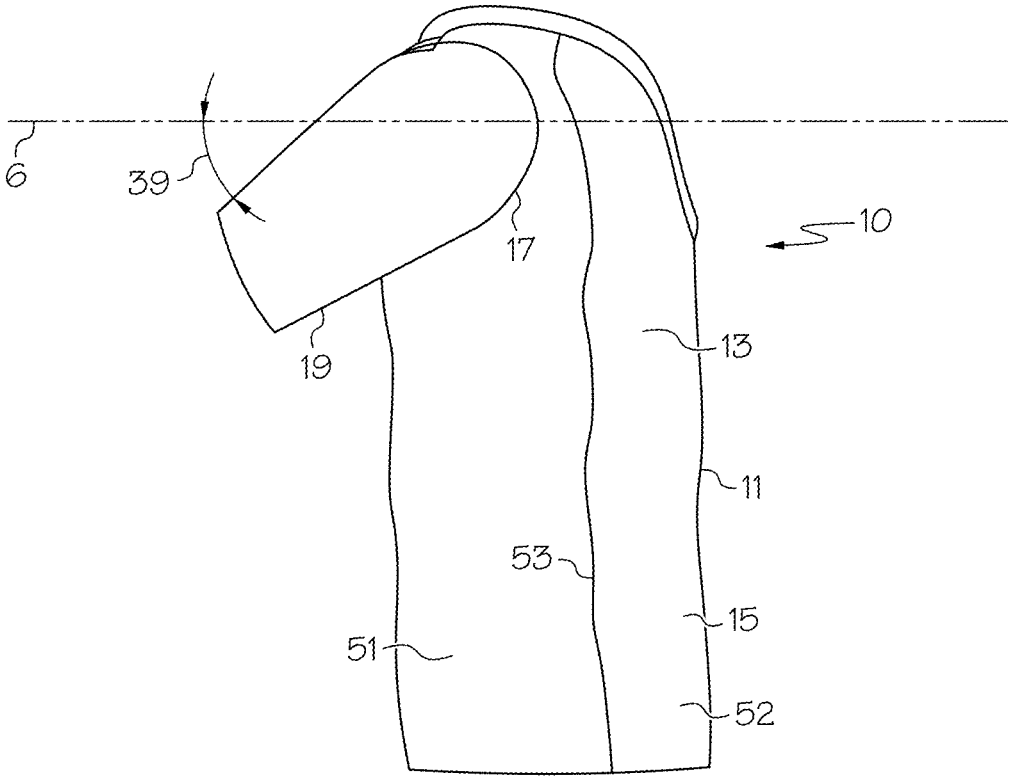
FIG. 10 depicts a side view of the notch sleeve support shirt of FIG. 6.

The sleeves 19 may be arranged in differing positions according to embodiments of the invention. For example, sleeves 19 can be placed in a more downward tilted position (see, e.g., FIG. 10), or less downward position (see, e.g., FIG. 6), to accommodate different bench pressing styles. Some lifters bench with a "flat back" on the bench which gives them a more vertical upward bar path in relation to their torso. Many lifters arch their back, which makes the bar path closer to that of a decline-bench press bar path where the lifter's knees are higher than his shoulders. In one embodiment, the sleeves 19 extend in a forward direction relative to a frontal plane 4 of the shirt body 11 and a downward direction relative to a transverse plane 6 of the shirt body 11 as shown in FIGS. 10 and 11.

Figure 11:
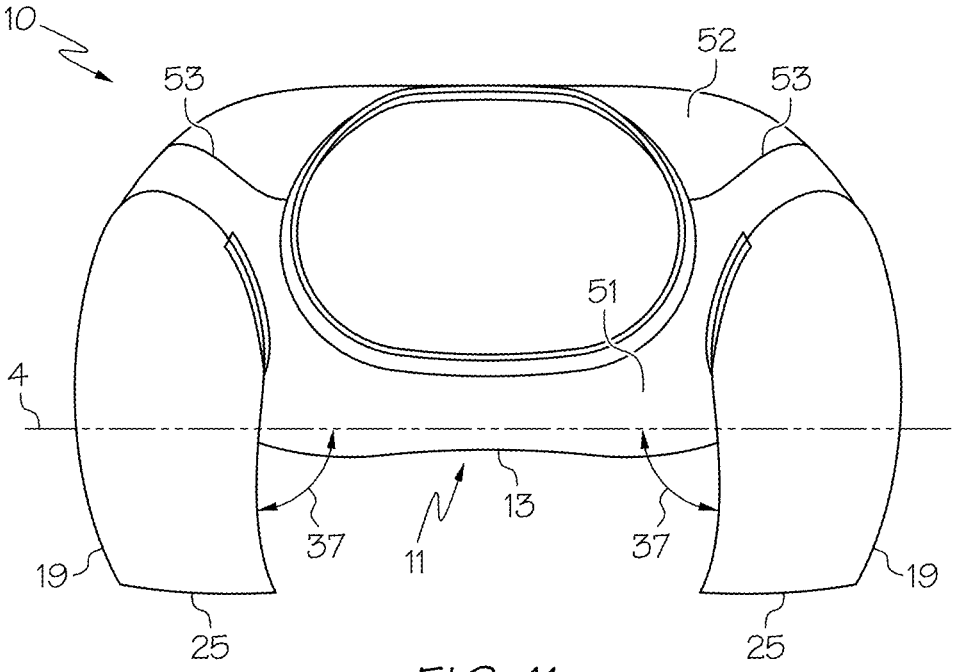
FIG. 11 depicts a top view of the notch sleeve support shirt of FIG. 6.

As shown in FIG. 11, in one embodiment sleeves 19 have a first central angle 37 of approximately 95° relative to the frontal plane 4. However, angle 37 may vary over a broad range depending on the desired use for the shirt. For example, angle 37 may vary between about 60° to about 180°. As shown in FIG. 10, in one embodiment sleeves 19 have a second central angle 39 of approximately 30° relative to the transverse plane 6 of the shirt body 11. However, angle 39 may vary over a broad range depending on the desired use for the shirt. For example, angle 39 may vary between an upwardly-directed angle of about 45° to a downwardly-directed angle of about 45° relative to transverse plane 6. In one embodiment, the fabric comprising the sleeves 19 has a tensile strength of about 90 psi, although fabrics of different tensile strengths may be used so long as the fabric has sufficient strength to maintain tautness during lifting.

Figure 2:
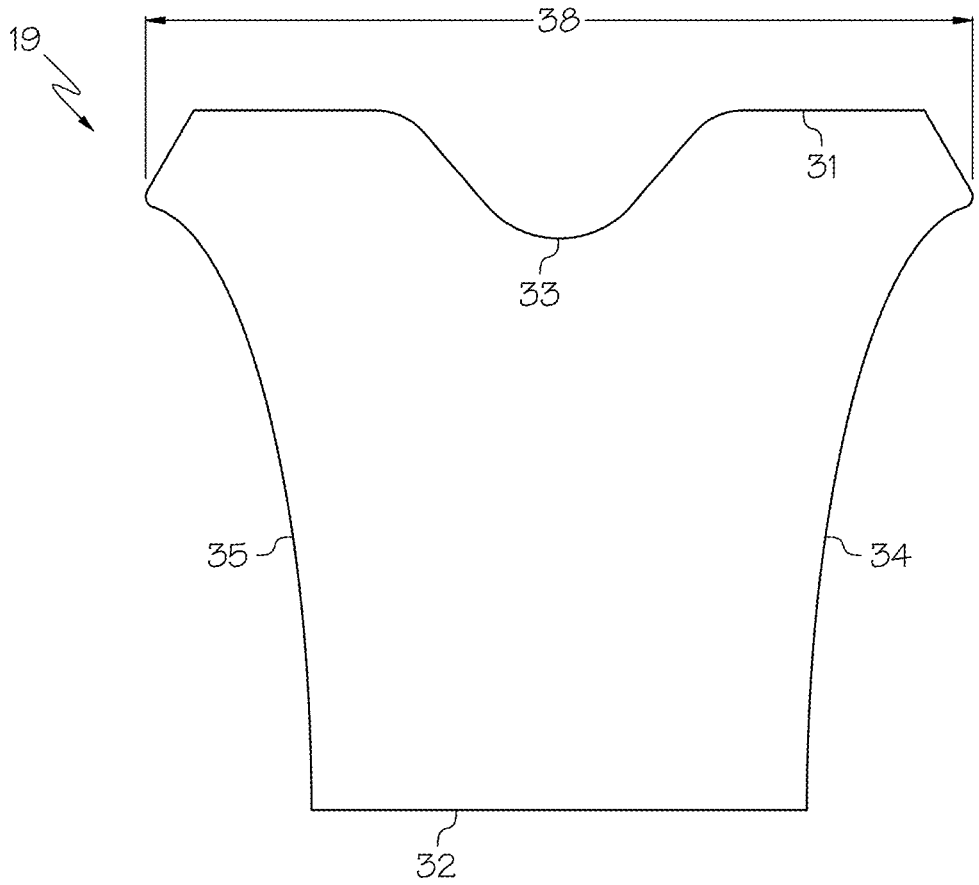
FIG. 2 depicts an enlarged side view of a sleeve of the embodiment in FIG. 1, showing the notch located on a first end of the sleeve approximately midway between the first and second edges.

FIGS. 1 and 2 depict a pattern for the fabric used to make support shirt 10. Sleeves 19 include sleeve body portions 31 at a first end thereof and a sleeve lower portion 32 at an opposite end of the sleeve. Typically, the sleeves are from about 10 to about 14 inches, preferably about 12 inches in length, depending on the size of the shirt as designed to fit various body sizes and types. In one embodiment, the width of the fabric across sleeve body portion 31 is greater than the width across lower sleeve portion 32. The opposing edges 34, 35 of the sleeves 19 are folded onto one another and joined at coupling seam 45 (see FIG. 6). Sleeve body portions 31 of sleeves 19 are attached to sleeve body holes 17 for example, by stitching one to the other. Typically, the sleeve holes are from about 5 to about 7 inches, preferably about 6 inches, in diameter. As shown, sleeve body portion 31 extends a distance 38 which corresponds to the circumference of the sleeve. Sleeve body portion 31 includes a notch 33. As shown, notch 33 extending in a curvilinear configuration at approximately the mid-point of sleeve body portion 31. While shown as a curved surface, notch 33 may also be configured as a groove, a channel, or a recess in the fabric.

Support shirt 10 is fabricated by joining each sleeve 19 together at coupling seam 45 and then attaching each sleeve 19 to respective shirt body holes 17. The distance 38 across sleeve body portion 31 is substantially equal to the circumference 39 of sleeve body holes 17. Typically, the distance 38 will be from about 15 to about 20 inches, depending on the size of the shirt to fit various body sizes and types of wearers. Because of the shape of body sleeve portion 31, which includes notch 33, when the sleeves are attached to the shirt body, the sleeves gradually curve or tilt inwardly (see FIGS. 6, 7, and 11) toward upper shirt body 11.

Figure 3:
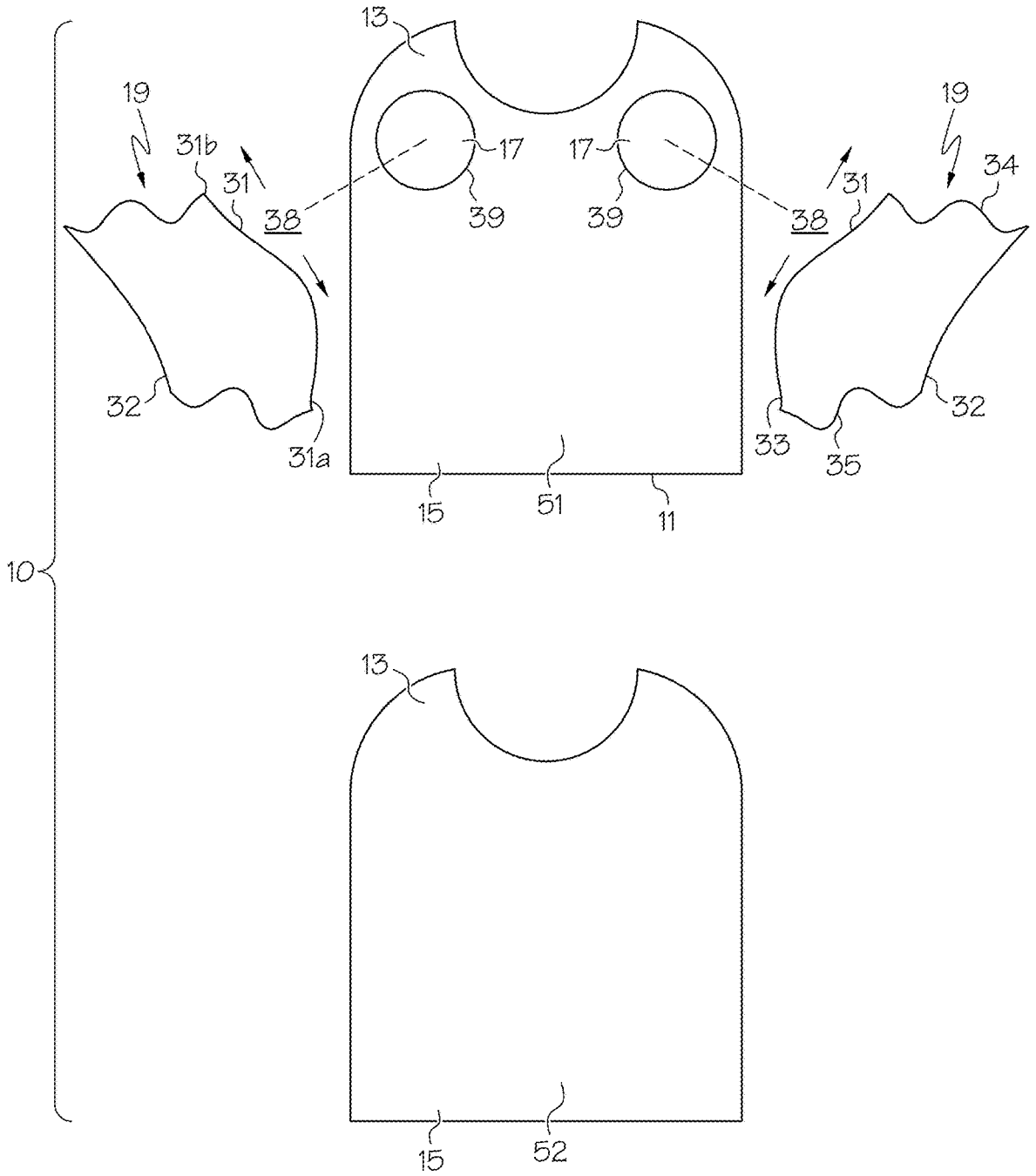
FIG. 3 depicts an exploded view of another embodiment of the support shirt design depicting a pattern for assembly of the front and back shirt body and sleeves.
Figure 4:
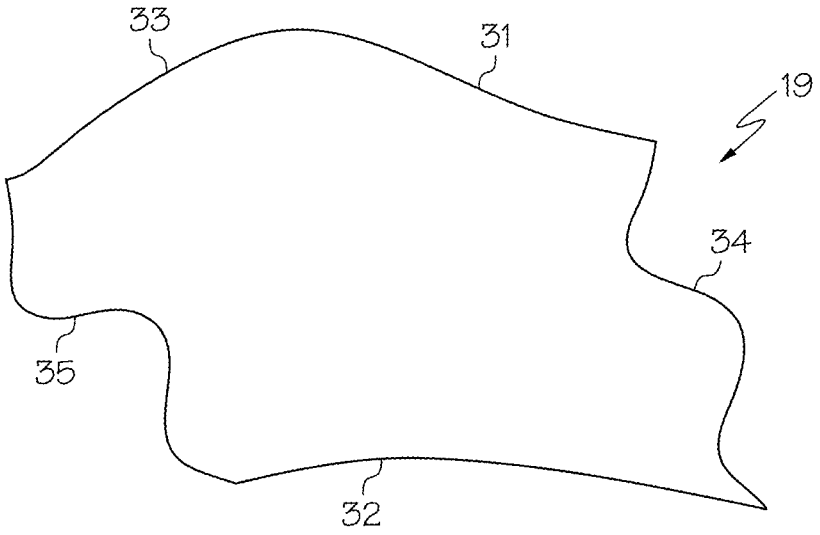
FIG. 4 depicts an enlarged side view of a sleeve of the embodiment in FIG. 3, showing the notch located on opposite edges of a first end of the sleeve.
Figure 5:
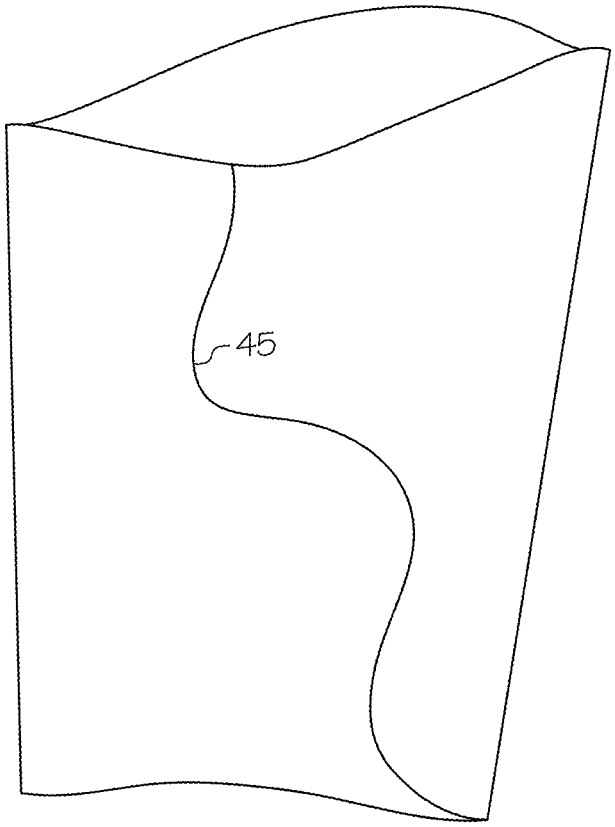
FIG. 5 depicts a side view of the sleeve of FIG. 4, with opposing edges joined together at a coupling seam.

In an alternative embodiment illustrated in FIGS. 3-5, where like elements are represented by like reference numerals, the notch in sleeve body portion 31 has been relocated such that complementary portions of the notch 31*a*, 31*b* are adjacent opposing edges 34, 35 of sleeve 19. When the opposing edges of the sleeve are joined together along coupling seam 45 as best seen in FIG. 5, the portions of the notch fit together to form sleeve 19. Again, typically, the length of the sleeves will be from about 10 to about 14 inches, preferably about 12 inches, and the sleeve holes will be from about 5 to about 7 inches, preferably about 6 inches, in diameter. The distance across the body portions of the sleeves is substantially equal to the circumference of the sleeve body holes.

Although certain embodiments of the present invention have been described in considerable detail, other embodiments within the scope of the invention are possible. For example, notch 33 may be located elsewhere along sleeve body portion 31. Sleeve body holes 17 may be positioned at other locations on upper shirt body 13. Support shirt 10 may also exist without a lower torso area or without a shirt back. The spirit and scope of the appended claims should not be limited to the descriptions of specific embodiments as described herein.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Unless the meaning is clearly to the contrary, all ranges set forth herein are deemed to be inclusive of all values within the recited range as well as the endpoints.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A support shirt comprising a shirt body and a pair of shirt body sleeves positioned adjacent to an upper portion of said support shirt body, said sleeves attached to said shirt body at round sleeve body holes located on the front of said shirt body, each of said sleeves having a first end adapted to be attached to a respective sleeve body hole, an opposite end, a first side edge and a second side edge, said first end of each of said sleeves including a notch portion located between opposing edges of said first end of each of said sleeves, and said first and second edges of each of said sleeves being joined together by a coupling seam.

2. The support shirt as claimed in claim 1 in which said notch comprises a curvilinear surface on said first end of each of said sleeves forming a groove, a channel, or a recess in said first end of each of said sleeves.

3. The support shirt as claimed in claim 1 in which said sleeves tilt downwardly and curve inwardly from said support shirt body.

4. The support shirt as claimed in claim 1 wherein said notch portion is located approximately midway between said first and second edges of each of said sleeves.

5. The support shirt as claimed in claim 1 in which said shirt body and said sleeves comprise a single- or multi-ply fabric comprised of canvas, polyester, spandex, nylon, or cotton.

6. The support shirt as claimed in claim 5 in which said fabric has a tensile strength of at least 90 psi.

7. The support shirt as claimed in claim 1 in which said sleeves extend forward of a frontal plane extending across said support shirt body at an angle of from 60° to 180°.

8. The support shirt as claimed in claim 7 in which said sleeves extend from a transverse plane extending substantially perpendicular to said frontal plane at an angle of from between +45° to −45°.

9. A support shirt comprising a shirt body and a pair of shirt body sleeves positioned adjacent to an upper portion of said support shirt body, said sleeves attached to said shirt body at round sleeve body holes located on the front of said shirt body, each of said sleeves having a first end adapted to be attached to a respective sleeve body hole, an opposite end, a first side edge and a second side edge, said first end of each of said sleeves including a notch portion located between opposing edges of said first end of each of said sleeves forming a groove in said first end of each of said sleeves, and said first and second edges of each of said sleeves being joined together by a coupling seam.

10. A support shirt comprising a shirt body and a pair of shirt body sleeves positioned adjacent to an upper portion of said support shirt body, said sleeves attached to said shirt body at round sleeve body holes located on the front of said shirt body, each of said sleeves having a first end adapted to be attached to a respective sleeve body hole, an opposite end, a first side edge and a second side edge, said first end of each of said sleeves including a notch portion located between opposing edges of said first end of each of said sleeves forming a channel in said first end of each of said sleeves, and said first and second edges of each of said sleeves being joined together by a coupling seam.

11. A support shirt comprising a shirt body and a pair of shirt body sleeves positioned adjacent to an upper portion of said support shirt body, said sleeves attached to said shirt body at round sleeve body holes located on the front of said shirt body, each of said sleeves having a first end adapted to be attached to a respective sleeve body hole, an opposite end, a first side edge and a second side edge, said first end of each of said sleeves including a notch portion located between opposing edges of said first end of each of said sleeves forming a recess in said first end of each of said sleeves, and said first and second edges of each of said sleeves being joined together by a coupling seam.

* * * * *